US011794312B2

(12) United States Patent
Liu

(10) Patent No.: US 11,794,312 B2
(45) Date of Patent: Oct. 24, 2023

(54) CUTTING PLIERS

(71) Applicant: TRIPLE WIN TECHNOLOGY (SHENZHEN) CO. LTD., Shenzhen (CN)

(72) Inventor: Song-Hao Liu, Shenzhen (CN)

(73) Assignee: TRIPLE WIN TECHNOLOGY (SHENZHEN) CO. LTD., Shenzhen (CN)

( * ) Notice: Subject to any disclaimer, the term of this patent is extended or adjusted under 35 U.S.C. 154(b) by 277 days.

(21) Appl. No.: 17/213,831

(22) Filed: Mar. 26, 2021

(65) Prior Publication Data

US 2022/0203503 A1 Jun. 30, 2022

(30) Foreign Application Priority Data

Dec. 24, 2020 (CN) ..... 202011554383.9

(51) Int. Cl.
*B25B 7/02* (2006.01)
*B25B 7/08* (2006.01)

(52) U.S. Cl.
CPC . *B25B 7/02* (2013.01); *B25B 7/08* (2013.01)

(58) Field of Classification Search
CPC ..... B25B 7/02; B25B 7/08
USPC ..... 81/342, 418–426.5
See application file for complete search history.

(56) References Cited

U.S. PATENT DOCUMENTS 156,054 A * 10/1874 Burger ..... A01K 15/003 72/409.02
4,651,554 A * 3/1987 Grudzinskas ..... H01H 9/286 81/426
5,084,935 A * 2/1992 Kalthoff ..... B25B 7/02 433/4
6,725,546 B1 * 4/2004 Dallas ..... B23D 29/002 7/130
7,670,357 B2 * 3/2010 Rettich ..... A61B 17/8861 606/205

* cited by examiner

*Primary Examiner* — Hadi Shakeri
(74) *Attorney, Agent, or Firm* — ScienBiziP, P.C.

(57) ABSTRACT

Cutting pliers include a first plier body and a second plier body. The first plier body includes a support end and a first handle coupled to each other. The second plier body includes a cutting end and a second handle coupled to each other. The first handle and the second handle are rotationally coupled by a connecting shaft. The support end and the cutting end cooperatively form jaws for cutting a pipe. The support end comprises a convex arcuate surface for supporting a pipe. The cutting end comprises two clamping arms and a blade. The blade is arranged between the two clamping arms. When the jaws are closed, a clamping end of the clamping arms abuts against the pipe, the pipe on the arcuate support surface is squeezed and deformed along the arcuate support surface to form an arcuate pipe, and the blade abuts against the arcuate pipe.

9 Claims, 7 Drawing Sheets

CUTTING PLIERS

FIELD

The subject matter herein generally relates to cutting pliers, and more particularly to cutting pliers for cutting a pipe.

BACKGROUND

Industrial pipes are widely used. Generally, the pipes are cut by blades, scissors, ordinary cutting pliers, laser cutting, high-pressure water cutting, etc. However, due to the high strength and pressure resistance of pipe materials, these above mentioned cutting tools may not cut the pipe with ease.

BRIEF DESCRIPTION OF THE DRAWINGS

Implementations of the present disclosure will now be described, by way of embodiments, with reference to the attached figures.

DETAILED DESCRIPTION

Figure 1:
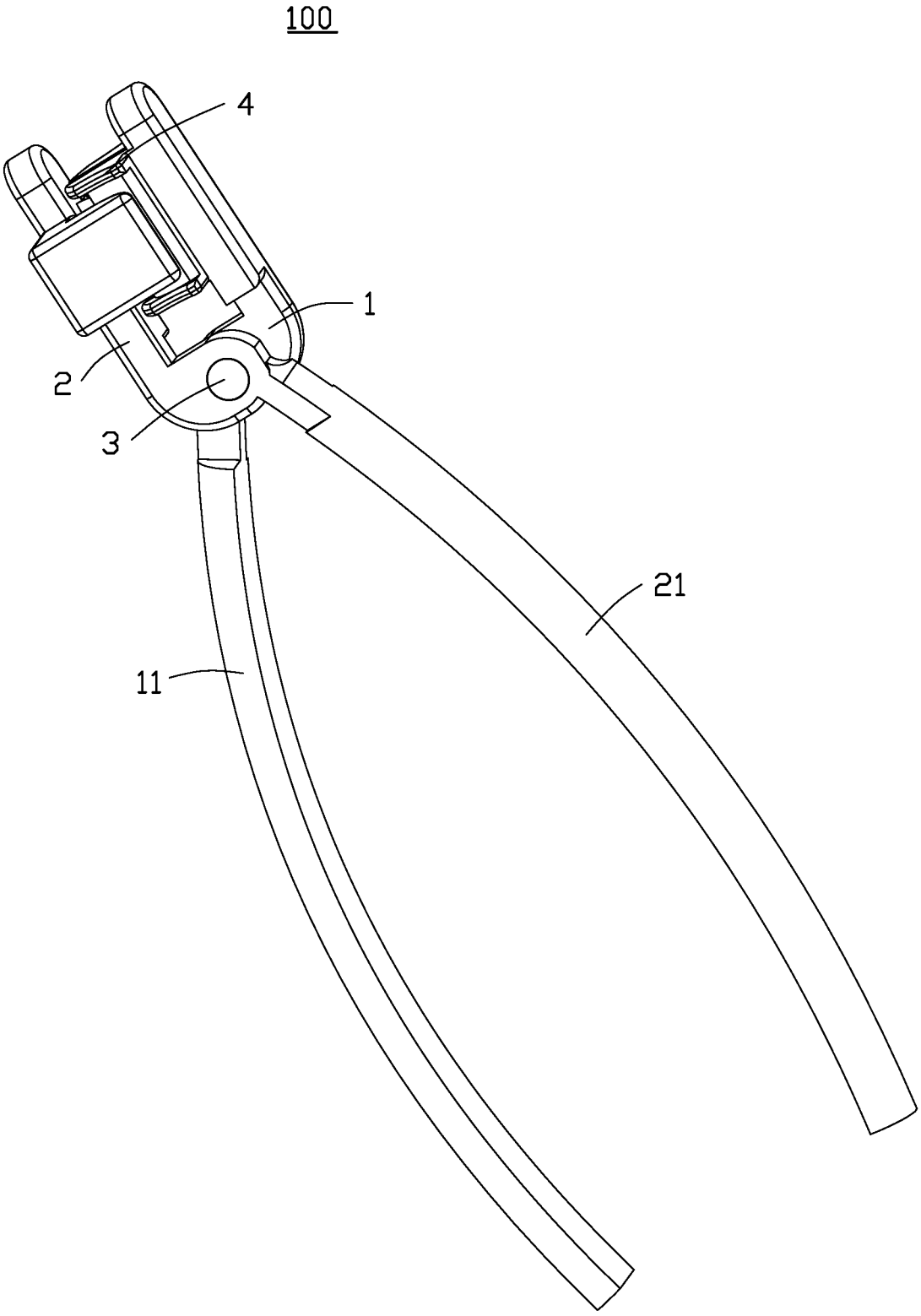
FIG. 1 is a perspective schematic diagram of cutting pliers according to an embodiment of the present disclosure.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or another word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series, and the like.

Figure 2:
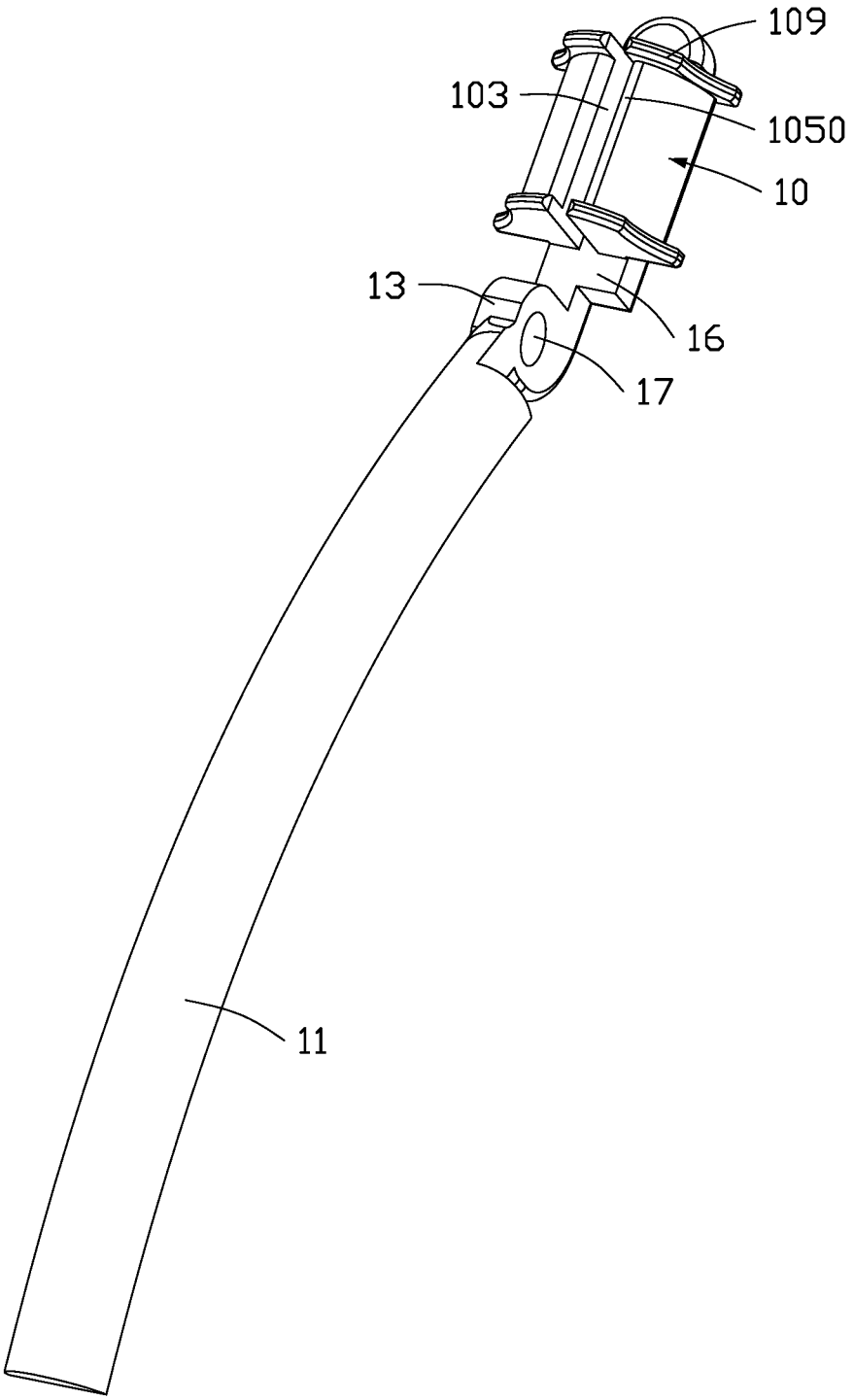
FIG. 2 is a perspective schematic diagram of a first plier body shown in FIG. 1.

FIG. 1 and FIG. 2 show an embodiment of cutting pliers 100. The cutting pliers 100 may be used for cutting a pipe. The cutting pliers 100 include a first plier body 1 and a second plier body 2. The first plier body 1 and the second plier body 2 are rotationally coupled by a connecting shaft 3. A first end portion of the first plier body 1 and the second plier body 2 constitute jaws 4. A second end portion of the first plier body 1 and the second plier body 2 are a first handle 11 and a second handle 21, respectively. By moving the first handle 11 and the second handle 21 away from or toward each other, the jaws 4 are closed or opened, and a pipe 5 can be placed in the jaws 4 or cut by the jaws 4.

The first plier body 1 further includes a support end 10. The support end 10 and the first handle 11 are coupled together. The support end 10 and the first handle 11 may be assembled together or integrally formed. The first handle 11 is arcuate. An end 13 of the first handle 11 extends outward to form a first support plate 14 (shown in FIG. 6). The support end 10 is arranged on the first support plate 14, and a gap 16 is between the support end 10 and the end 13 of the first handle 11.

Figure 4:
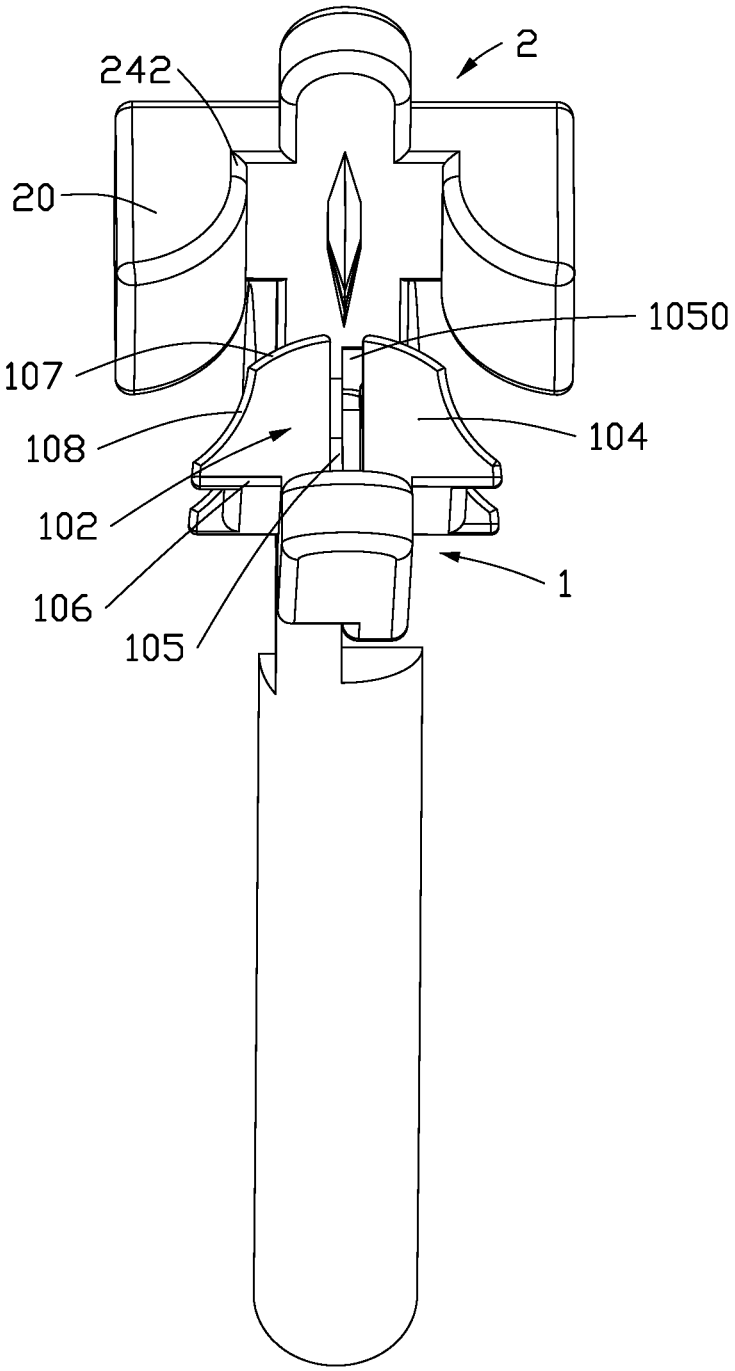
FIG. 4 is a perspective schematic diagram of the first plier body and the second plier body in an unconnected state.

Referring to FIG. 4, the support end 10 has a substantially semicircular cylindrical structure. The support end 10 includes a first support body 102 and a second support body 104. The first support body 102 and the second support body 104 are substantially the same, and a slot 103 is between the first support body 102 and the second support body 104.

Each of the first support body 102 and the second support body 104 includes two opposite surfaces (not labeled), a first side wall 105, a second side wall 106, a first arcuate side surface 107 and a second arcuate side surface 108.

The first side wall 105 and the second side wall 106 are substantially perpendicular to each other. The second side wall 106 is fixed on the first support plate 14. The two opposite surfaces are substantially perpendicular to the first support plate 14, and a non-slip baffle 109 is attached to the two surfaces. When the pipe 5 is placed on the support end 10, the non-slip baffle 109 prevents the pipe 5 from slipping off the support end 10 during cutting.

The first arcuate side surface 107 is a convex arcuate surface, which is formed by extending a top edge 1050 of the first side wall 105 located away from the first support plate 14 toward the first support plate 14 to support the pipe 5. The second arcuate side surface 108 is a concave arcuate surface, which is adjacent to the first arcuate side surface 107 and extends toward the first support plate 14 for supporting the second plier body 2.

A structure of the second support body 104 is substantially the same as the first support body 102, and the second support body 104 and the first support body 102 are arranged as mirror opposites. The first side wall 105 of the second support body 104 is arranged opposite the first side wall 105 of the first support body 102, and the slot 103 is located between the first side wall 105 of the second support body 104 and the first side wall 105 of the first support body 102. The first arcuate side surfaces 107 of the first support body 102 and the second support body 104 jointly form an arcuate support surface for supporting the pipe 5.

Figure 5:
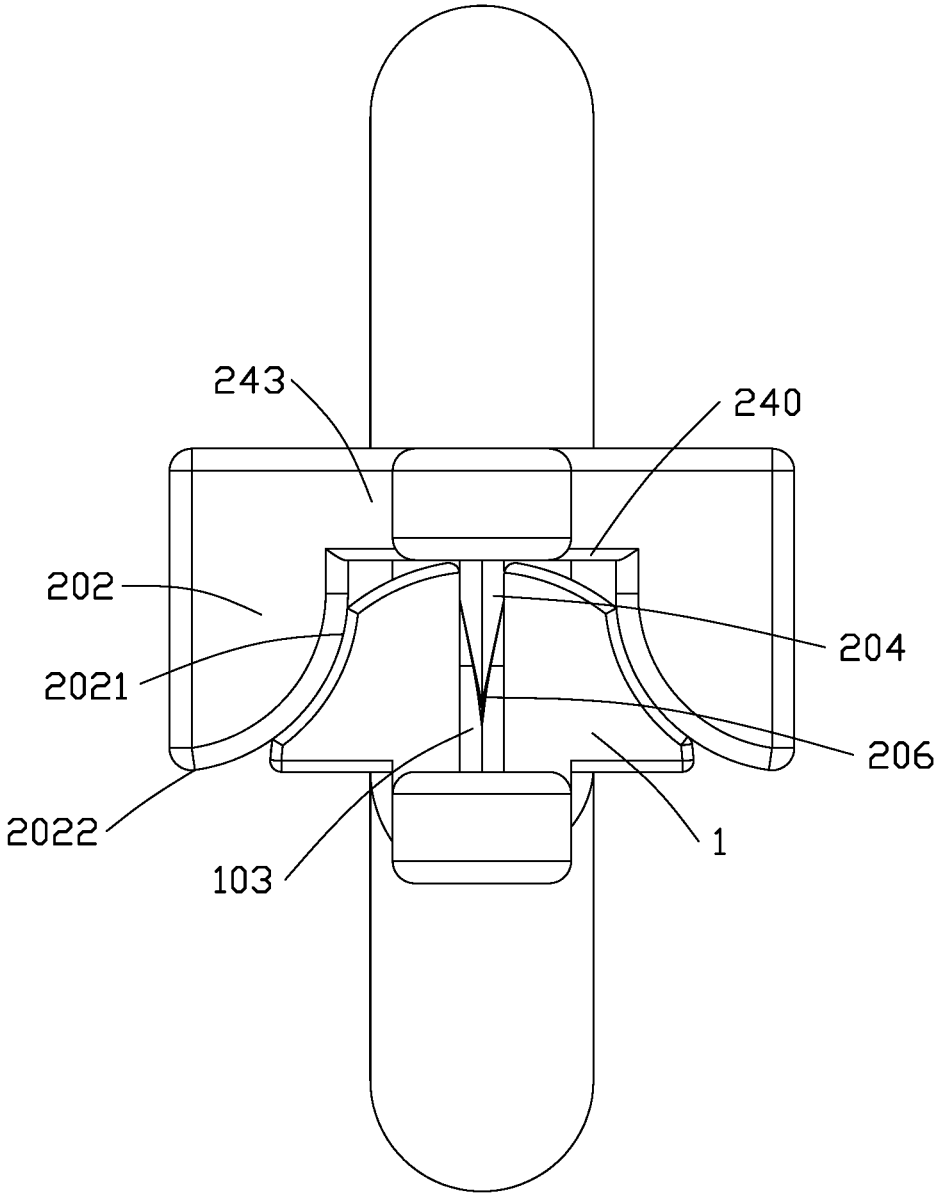
FIG. 5 is a perspective schematic diagram of a shaft connection state of the first plier body and the second plier body.

Referring to FIGS. 4 and 5, when the pipe 5 is placed flat on the arcuate support surface of the first support body 102 and the second support body 104 and is pressed by an external force, a portion of the pipe 5 located between the first support body 102 and the second support body 104 is deformed along the first arcuate side surfaces 107 to form an arcuate pipe 50. A length of the arcuate pipe 50 is substantially equal to an arc of the arcuate support surface formed by the first arcuate side surfaces 107. The arcuate pipe 50 includes a top 52. A position of the top 52 corresponds to a position of the slot 103. In one embodiment, the top 52 is directly opposite the slot 103.

The first handle 11 has a substantially arcuate structure and defines a first through hole 17 (shown in FIG. 2) adjacent to the jaws 4.

Figure 3:
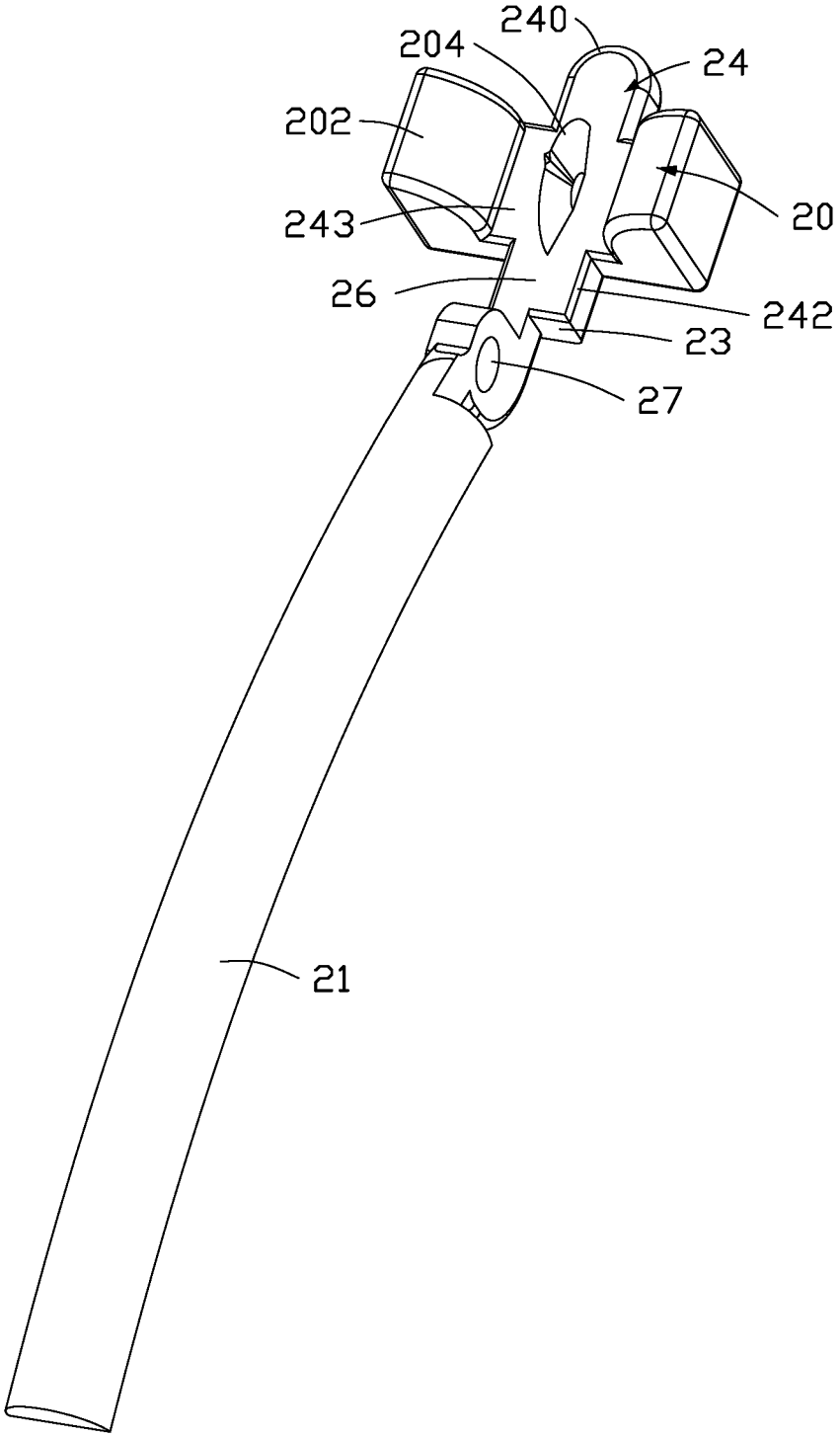
FIG. 3 is a perspective schematic diagram of a second plier body shown in FIG. 1.

Referring to FIG. 3, the second plier body 2 further includes a cutting end 20, and the cutting end 20 and the second handle 21 are coupled together. The cutting end 20 and the second handle 21 may be assembled together or integrally formed. An end 23 of the second handle 21 extends outward to form a second support plate 24. The cutting end 20 is arranged on a first surface 240 of the second support plate 24, and a gap 26 is between the end 23 of the handle 21 and the cutting end 20. Two sides 242 of the first surface 240 extend outward to form the support platform 243.

The cutting end 20 includes two clamping arms 202 and a blade 204. The two clamping arms 202 are arranged spaced apart from each other, and the blade 204 is arranged between the two clamping arms 202. The clamping arms 202 are formed by extending the support platform 243 outward. Each clamping arm 202 includes a clamping surface 2021. The clamping surface 2021 is a convex arcuate surface. When the first plier body 1 and the second plier body 2 are pressed together, the clamping surfaces 2021 are opposite the second arcuate side surfaces 108 of the first plier body 1. A clamping end 2022 of the clamping arm 202 moves along the concave arcuate surface of the second arcuate side surface 108 to clamp and fix the pipe 5 on the first plier body 1 to realize cutting of the pipe 5.

The blade 204 is arranged on the first surface 240 of the second support plate 24 and is located between the two clamping arms 202. The blade 204 can be fixedly arranged on the first surface 240 by a fixing device. In one embodiment, the blade 204 is detachably arranged on the first surface 240 by a detachable mechanism, and the detachable mechanism is removed to remove the blade 204. In another embodiment, the blade 240 can be directly removed and replaced on the first surface 240 through other mechanisms.

The blade 204 includes a cutting edge 206, which may have a triangular shape or a semicircular shape. A middle of the blade 206 is provided with a spike (not shown), and the blade 204 gradually becomes thinner from a bottom of the blade 204 to the cutting edge 206. A pressure of the cutting edge 206 is increased when a force is applied on the blade 204. The cutting edge 206 of the blade 204 corresponds to the top 52 of the pipe 5, and the top 52 requires a minimum force for the blade 204 to cut. The blade 204 corresponds in position of the slot 103 of the first plier body 1. After cutting the pipe 5, the blade 204 is embedded in the slot 103. The slot 103 may fully or partially accommodate the blade 204. In one embodiment, the slot 103 fully accommodates the blade 204.

The second handle 21 has substantially the same structure as the first handle 11 and has an arcuate structure. A second through hole 27 is defined in the second handle 21, and the second through hole 27 is adjacent to the jaws 4.

Figure 6:
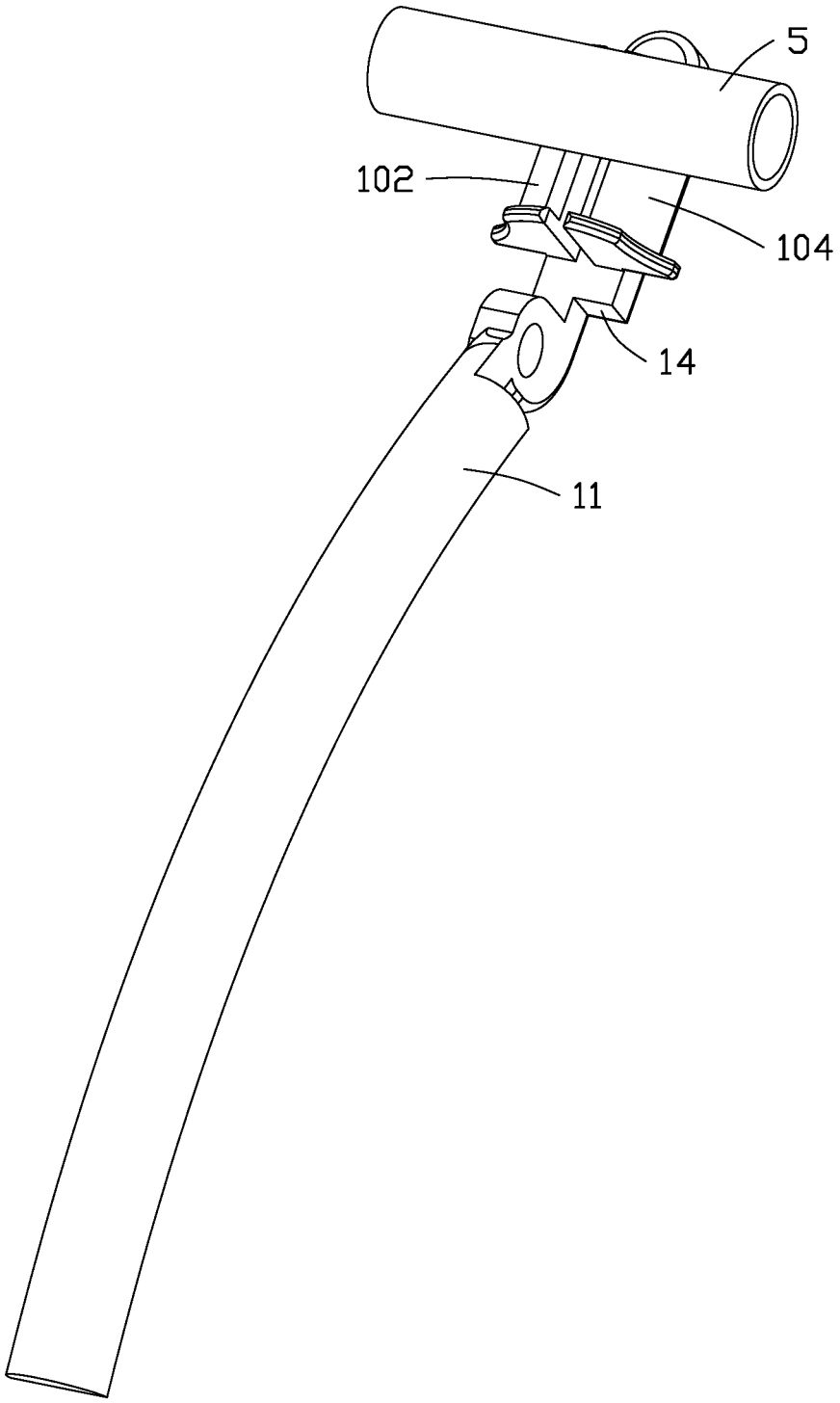
FIG. 6 is a perspective schematic diagram of a pipe to be cut placed on the first plier body.
Figure 7:
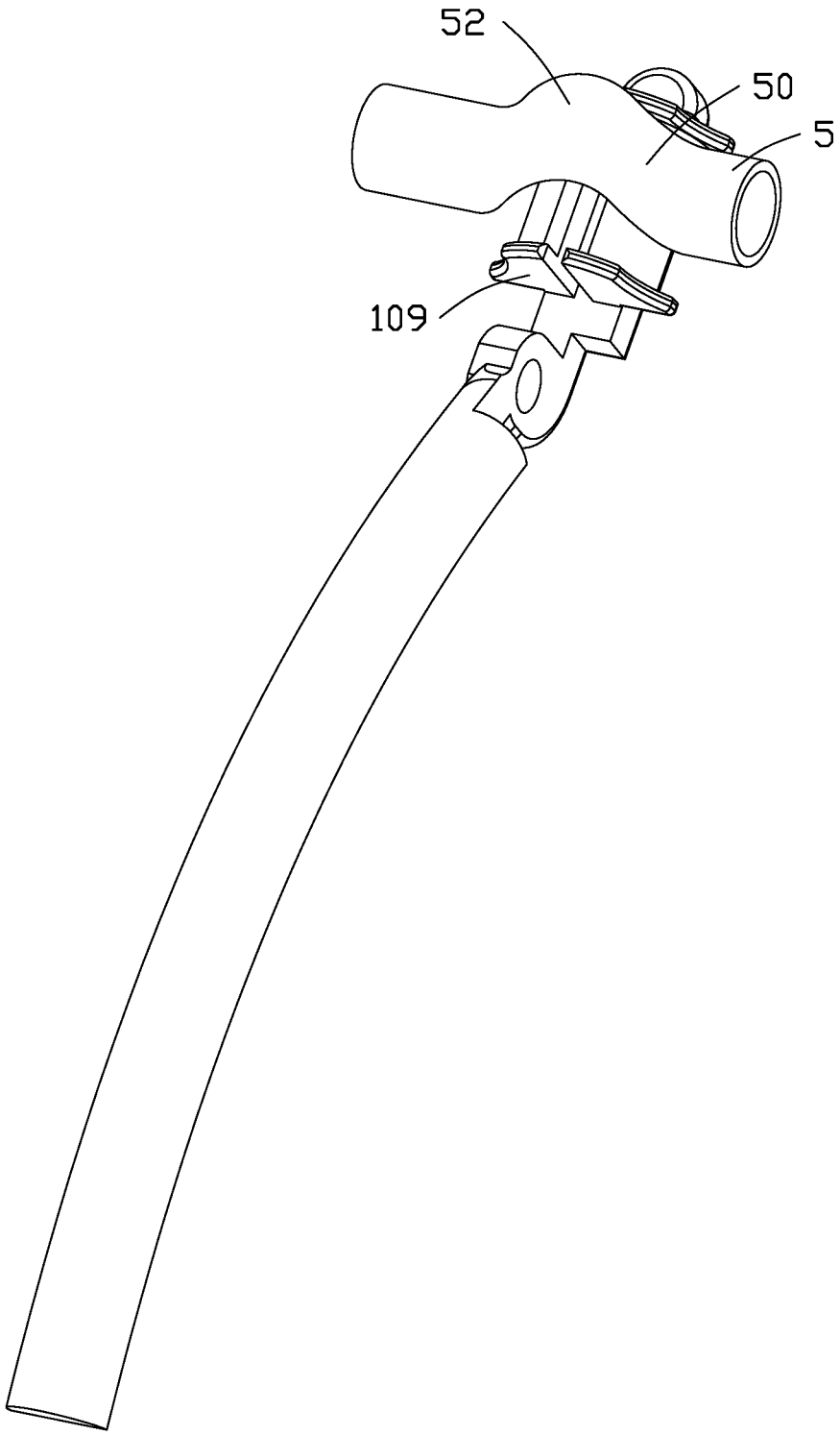
FIG. 7 is a perspective schematic diagram of the pipe in a squeezed state on the first plier body.

Referring to FIGS. 6 and 7, the connecting shaft 3 is inserted through the first through hole 17 of the first handle 11 and the second through hole 27 of the second handle 21, thereby rotationally coupling the first plier body 1 and the second plier body 2 together.

In summary, the air tube 5 is first placed on the support end 10 of the first plier body 1, such that the air tube 5 lies flat on the first arcuate side surfaces 107 of the first support body 102 and the second support body 104. Then, the first handle 11 and the second handle 21 are pressed together, so that the support end 10 of the first plier body 1 pushes and squeezes the cutting end 20 of the second plier body 2, and the clamping arms 202 of the cutting end 20 expand outward to clamp the pipe 5 on the second arcuate side surfaces 108 of the support end 10, so that the pipe 5 is gradually squeezed into an arcuate shape. Then, the cutting edge 206 of the blade 204 facing the arcuate pipe 50 cuts the top 52 of the pipe 5 with minimal effort. After the blade 204 cuts the pipe 5, the blade is embedded in the slot 103 on the first plier body 1. The support end 10 provided with the non-slip baffle 109 prevents the pipe 5 from slipping off the support end 10 when the pipe 5 is placed on the support end 10. Thus, the pipe 5 can be easily cut in the jaws 4 of the cutting pliers 100.

The cutting pliers 100 has the following beneficial effects. By setting the support end 10 with an arcuate support surface, the pipe 5 is pressed into the arcuate pipe 50 in a shorter length, and the blade 204 is correspondingly arranged in a triangular or arcuate shape with a spike. The moment the blade 204 contacts the arcuate pipe 50, a pressure at a tangent point of the arcuate pipe 5 is approximately infinite, and cutting can be easily completed. The scope of application of the pipe 5 in this embodiment is from 4 mm to 12 mm, and the cutting pliers 100 can easily be scaled up for the pipes of 12 mm or more.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. Cutting pliers comprising:

a first plier body, the first plier body comprising a support end and a first handle coupled to each other;

a second plier body, the second plier body comprising a cutting end and a second handle coupled to each other; wherein:

the first handle and the second handle are rotationally coupled by a connecting shaft, an end of the first handle extends outward to form a first support plate;

the support end and the cutting end cooperatively form jaws configured for cutting a pipe;

the support end comprises a convex arcuate surface for supporting a pipe;

the cutting end comprises two clamping arms and a blade;

the blade is arranged between the two clamping arms; and the support end comprises a first support body and a second support body which are arranged spaced apart from each other, each of the first support body and the second support body comprises a first side wall, a second side wall, a first arcuate side surface, and a second arcuate side surface, the first arcuate side surface is formed by the first side wall extending toward the first support plate, the first arcuate side surfaces of the first support body and the second support body cooperatively form the convex arcuate support surface, the first side walls of the first support body and the second support body are arranged opposite each other; and when the jaws are closed, a clamping end of the clamping arms abuts against the pipe, the pipe on the convex arcuate support surface is squeezed and deformed along the convex arcuate support surface to form an arcuate pipe, and the blade abuts against the arcuate pipe.

2. The cutting pliers of claim 1, wherein a cutting edge of the blade is triangular or semicircular.

3. The cutting pliers of claim 2, wherein:

when the jaws are closed, a point of the blade abuts against a top end of the arcuate pipe.

4. The cutting pliers of claim 3, wherein:

the blade gradually becomes thinner from a bottom of the blade to the cutting edge of the blade.

5. The cutting pliers of claim 4, wherein:

the blade is detachably mounted on the cutting end.

6. The cutting pliers of claim 1, wherein:

a slot is located between the first side walls of the first support body and the second support body; and the slot is configured for accommodating the blade.

7. The cutting pliers of claim 6, wherein:

a non-slip baffle is provided on two surfaces of the first support body and the second support body.

8. The cutting pliers of claim 7, wherein:

the clamping arms comprise a clamping surface;

the clamping surface is a convex arcuate surface;

the second arcuate side surfaces of the first plier body are a concave arcuate surface; and the clamping surface is positioned opposite the second arcuate side surfaces and used for clamping the pipe.

9. The cutting pliers of claim 8, wherein:

an end of the first handle extends outward to form a flat first support plate;

the support end is arranged on the first support plate;

an end of the second handle extends outward to form a flat second support plate;

the cutting end is arranged on a first surface of the second support plate;

two sides of the first surface extend outward to form a support platform; and the clamping arms are formed by extending ends of the support platform outward.

* * * * *